US008186064B2

(12) United States Patent
Pragt et al.

(10) Patent No.: US 8,186,064 B2
(45) Date of Patent: May 29, 2012

(54) SHAVING APPARATUS

(75) Inventors: Johan Pragt, Drachten (NL); Fokke Roelof Voorhorst, Drachten (NL); Jan Spoelstra, Drachten (NL); Alastair Ian Blake, Drachten (NL); Bastiaan Johannes De Wit, Drachten (NL); Jasper Zuidervaart, Drachten (NL); Albert Maas De Lange, Drachten (NL); Anna Dirkje Bosma, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 212 days.

(21) Appl. No.: 10/594,016

(22) PCT Filed: Mar. 18, 2005

(86) PCT No.: PCT/IB2005/050945

§ 371 (c)(1),
(2), (4) Date: Sep. 22, 2006

(87) PCT Pub. No.: WO2005/092579

PCT Pub. Date: Oct. 6, 2005

(65) Prior Publication Data

US 2007/0209211 A1 Sep. 13, 2007

(30) Foreign Application Priority Data

Mar. 26, 2004 (EP) ..... 04101266

(51) Int. Cl.
*B26B 19/06* (2006.01)

(52) U.S. Cl. ..... 30/43.92; 30/208; 30/223; 30/225; 30/346.51; 30/346.55; 30/357

(58) Field of Classification Search ..... 30/43.91, 30/43.92, 42, 43, 43.1, 43.7, 43.8, 43.9, 196, 30/197, 200–202, 208–210, 215–220, 223–228, 30/346, 346.5, 346.51, 346.55, 357
See application file for complete search history.

(56) References Cited

U.S. PATENT DOCUMENTS

| | | | | | |
|---|---|---|---|---|---|
| 327,512 | A | * | 10/1885 | Bekofsky | 30/201 |
| 1,115,328 | A | * | 10/1914 | Murran | 30/223 |
| 1,241,798 | A | * | 10/1917 | Werner | 30/43.92 |
| 1,798,756 | A | * | 3/1931 | Redfield | 30/210 |
| RE20,169 | E | * | 11/1936 | Viall | 30/43.92 |
| 2,077,367 | A | * | 4/1937 | Hanley | 30/43.92 |
| 2,252,601 | A | * | 8/1941 | Murphy | 30/211 |
| 2,281,434 | A | * | 4/1942 | Gur Arye | 30/43.92 |
| 2,652,626 | A | * | 9/1953 | Dutcher | 30/228 |
| 2,674,795 | A | * | 4/1954 | Long | 30/216 |
| 3,711,948 | A | | 1/1973 | Ford et al. | |
| 4,152,830 | A | | 5/1979 | Meijer et al. | |
| 4,221,049 | A | | 9/1980 | Hamashima | |
| 4,490,907 | A | | 1/1985 | Benedictus | |
| 6,308,415 | B1 | * | 10/2001 | Sablatschan et al. | 30/43.92 |
| 6,658,740 | B2 | | 12/2003 | Habben | |

* cited by examiner

*Primary Examiner* — Clark F. Dexter

(57) ABSTRACT

Shaving apparatus with cutting members which are movable relative to one another and are each provided with a row of substantially V-shaped teeth having edges, a cutting opening between each pair of cooperating teeth for catching hairs, said cutting opening having a shearing angle between 1° and 30°, wherein the cutting openings are not completely closed during operation of the shaving apparatus.

18 Claims, 3 Drawing Sheets

SHAVING APPARATUS

Figure 1:
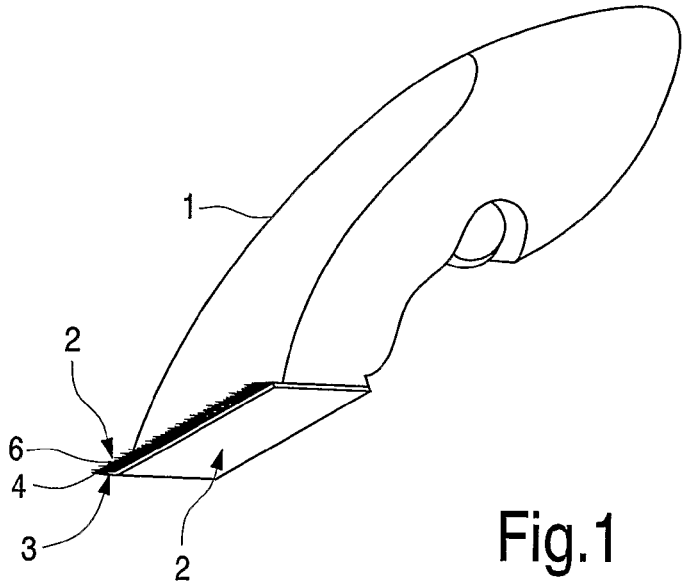

The invention relates to a shaving apparatus comprising two cooperating cutting members that are movable relative to each other and that are each provided with at least one edge, wherein the edges of the cutting members cooperate and wherein a cutting opening is present between the edges of the cutting members for catching hairs, said cutting opening diverging when seen in a shaving direction of the apparatus.

Such a shaving apparatus is known, for example, from U.S. Pat. No. 6,308,415. In these shaving apparatuses, also called hair clipping devices or trimmers, hairs are caught between the tooth edges of the teeth in the cutting opening or hair trapping opening and are subsequently cut off by the reciprocal movement of the cutting edges with respect to one another. The teeth of the one, usually moving cutting member here move entirely over the teeth of the other, usually stationary cutting member, i.e. the tooth edges provided with cutting edges move alongside one another so far that the cutting openings are completely closed. One moving tooth overlaps a plurality of stationary teeth during operation in most of such shaving apparatuses. Not only hairs enter the cutting openings during operation, but also skin arrives somewhat between the edges of the teeth. The skin is pushed away from the cutting opening for the major part during the movement of two mutually cooperating cutting edges towards one another thanks to the skin's elasticity. Nevertheless, these shaving apparatuses still cause skin irritation in many cases, and skin damage does arise.

It is an object of the invention to provide a shaving apparatus in which the risk of skin damage is very small, practically nil, during shaving.

This object is achieved with the shaving apparatus according to the invention, which is characterized in that the cutting openings are not entirely closed during operation of the apparatus. It was surprisingly found that skin damage is considerably less if the cutting edges of two cooperating teeth leave a small cutting opening open. Apparently the skin is not sufficiently pressed away adjacent the tips of the teeth in the known shaving apparatuses, with the result that the cutting edges damage the skin there. This problem is counteracted by a shaving apparatus in which small cutting openings remain between the teeth at all times during operation.

It is favorable for a satisfactory cutting-through of a hair when both tooth edges are provided with cutting edges in the region where the cutting opening is closed during operation.

A further embodiment thereof is characterized in that the zone between the tip of the tooth and the cutting edge of one of the two cooperating tooth edges forms an abutment for a hair caught in the cutting opening.

In an alternative embodiment, it is also possible that both tooth edges are provided with cutting edges over their entire length.

Preferably, the shearing angle between the cooperating tooth edges is between 5° and 25°.

A particularly favorable embodiment is characterized in that the cutting members perform a stroke S relative to one another for which it holds that 0.01 mm<S<0.15 mm, with a frequency Q for which it holds that Q>100 Hz. Preferably, the stroke lies between 0.05 mm and 0.1 mm and the frequency between 150 Hz and 400 Hz.

The stroke is chosen such that the cutting edges cannot damage the skin during operation of the shaving apparatus on the one hand, while on the other hand a permanent damage to a hair caught between the cutting edges is effected. Tests have shown that, if the stroke is smaller than 0.15 mm, the skin moves along with the cutting member fully elastically. It was furthermore found that the stroke must be at least 0.01 mm for achieving a plastic deformation of a hair. Since the stroke is smaller than the hair thickness, the hair is not cut through until after a number of cutting movements. This is possible because the user moves the apparatus in a direction perpendicular to the stroke over the skin during shaving. The frequency of the driven cutting member must not be too small for this reason, because otherwise a painful hair pulling will occur. It was found that the frequency should be at least 100 Hz.

It is noted that U.S. Pat. No. 2,281,434 describes a shaving apparatus in which the driven cutting member has a maximum stroke of approximately 0.020" (≈0.5 mm) and a hair is to be cut through in one stroke. The latter means that the minimum stroke length must be 0.28 mm, because a hair has a maximum thickness of approximately 0.28 mm. It is not known from this patent document, moreover, with what frequency the driven cutting member moves.

Figure 2A:
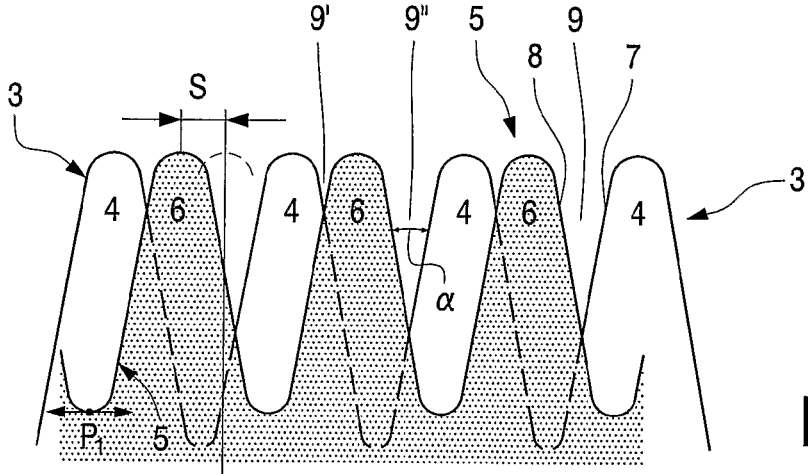
Figure 2B:
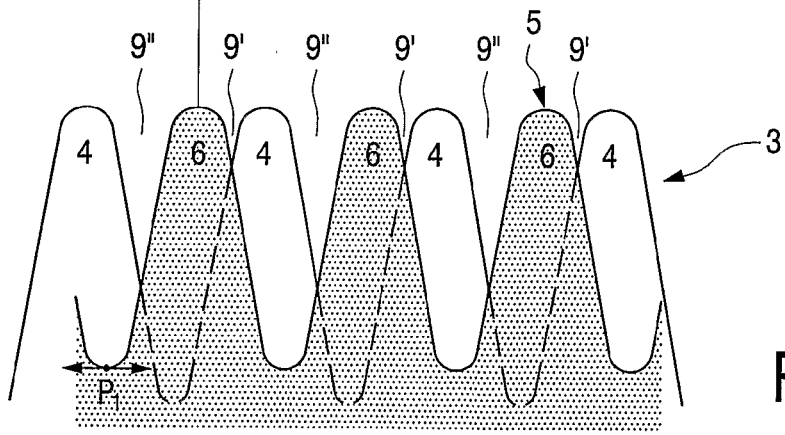
Figures 3A, 3B, 3C, 3D, 3E, 3F, 4A, 4B, 4C:
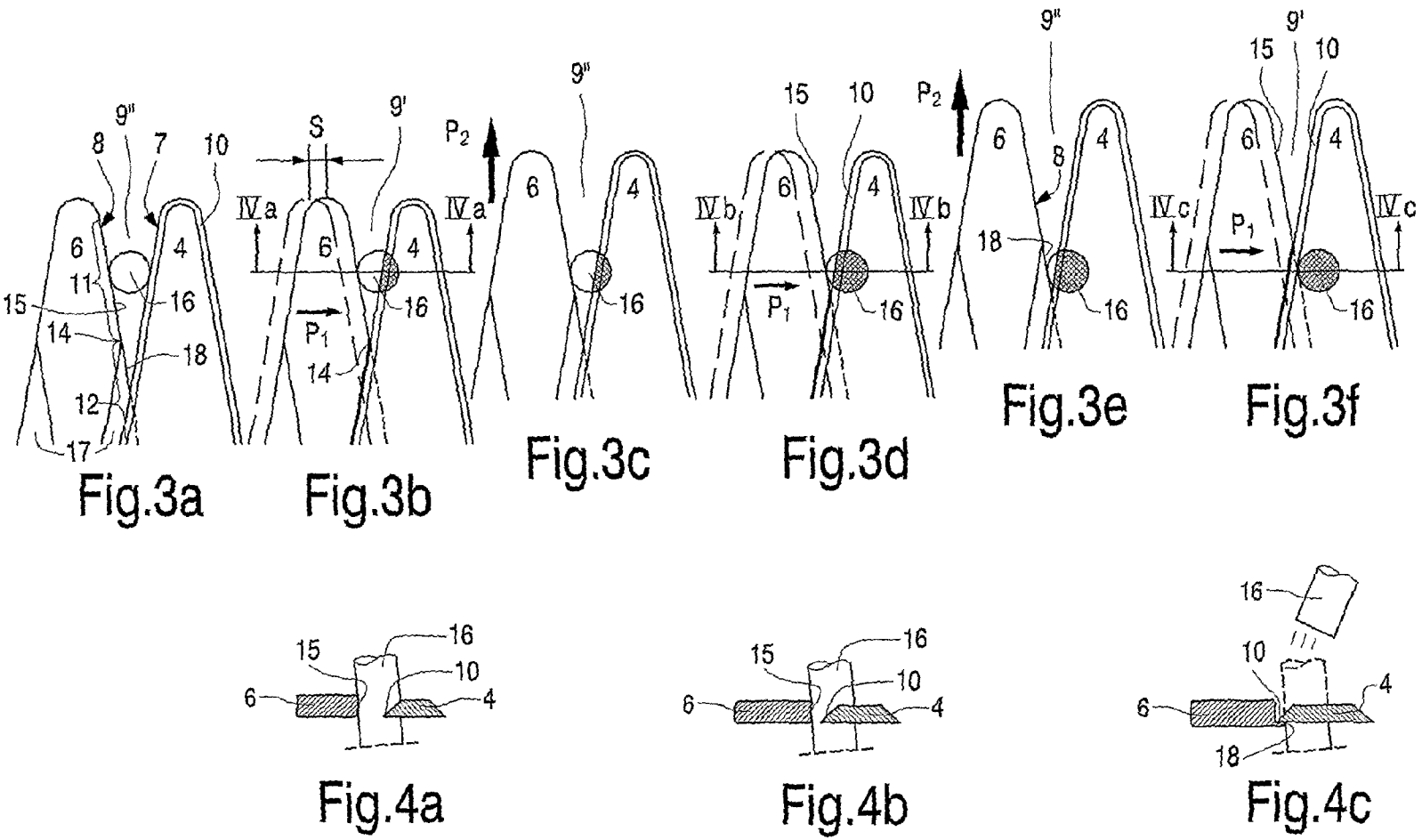
Figure 5A:
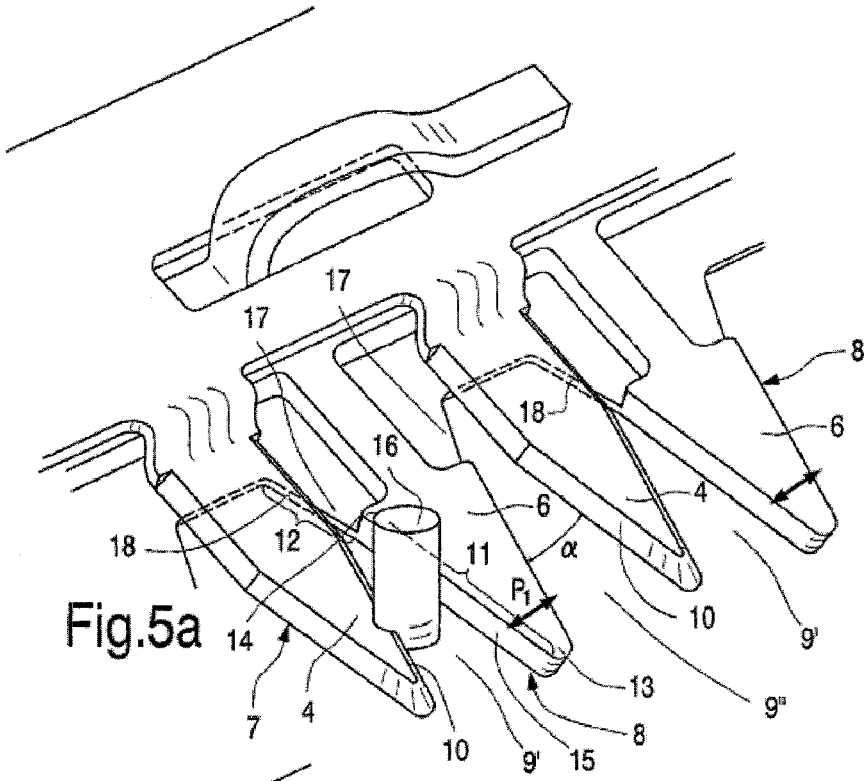
Figure 5B:
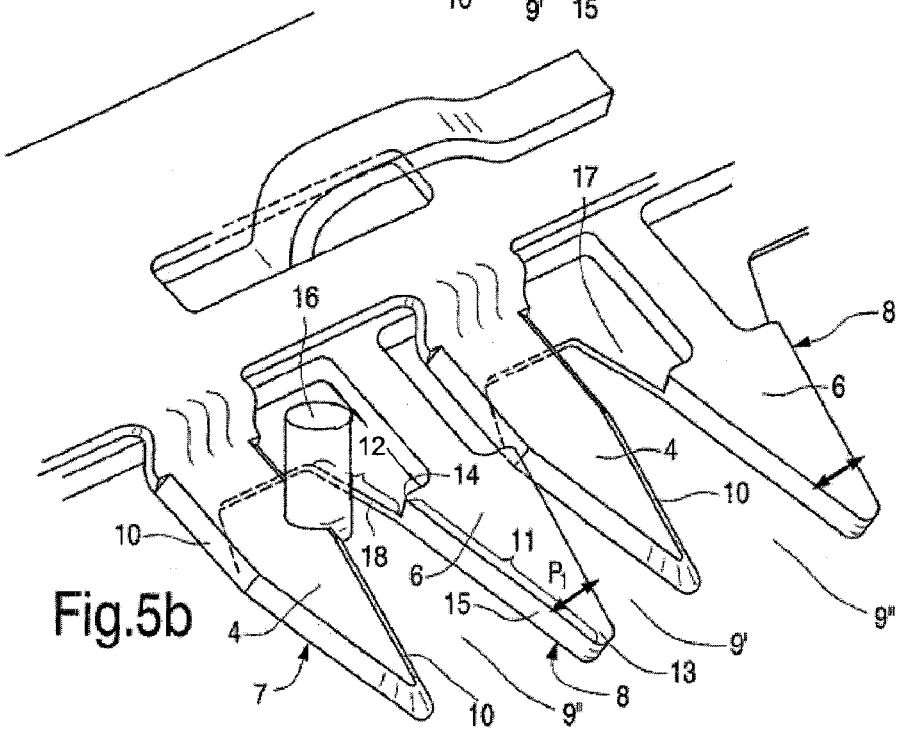

The invention will now be explained in more detail below with reference to an embodiment shown in a drawing, in which FIG. 1 shows a shaving apparatus according to the invention in perspective view, FIGS. 2*a* and 2*b* diagrammatically show a number of teeth of the cooperating cutting members in two extreme positions of the cutting members relative to one another, FIGS. 3*a-f* diagrammatically show the severing of a hair in a number of consecutive phases, FIGS. 4*a*, 4*b*, and 4*c* are cross-sectional views taken on the lines IVa-IVa, IVb-IVb, and IVc-IVc in FIGS. 3*b*, 3*d*, and 3*f*, respectively, and FIGS. 5*a* and 5*b* show the situations of FIGS. 3*b* and 3*e*, respectively, in perspective view.

The shaving apparatus shown in FIG. 1 comprises a housing 1 with a shaving head 2. The shaving head has a stationary cutting member 3 comprising a row of substantially V-shaped teeth 4, and a movable, driven cutting member 5, also with a row of substantially V-shaped teeth 6.

FIGS. 2*a* and 2*b* show a number of teeth of cooperating cutting members 3 and 5 in two situations. The driven cutting member is shown hatched in these Figures. FIG. 2*a* shows the situation in which the driven cutting member 5 is in its one extreme position, the left-hand position in the Figure, and FIG. 2*b* shows it in its other extreme position, the right-hand position in the Figure. The driven cutting member 5 performs a reciprocating movement with respect to the stationary cutting member, indicated with the double arrow $P_1$, with a stroke length S. The teeth 4 of the stationary cutting member 3 have sloping tooth edges 7, and the teeth 6 of the driven cutting member 5 have sloping tooth edges 8. A hair trapping opening or cutting opening 9', 9" is present between the tooth edges 7 and 8 of each pair of mutually cooperating teeth. The angle α between the tooth edges 7 and 8, also denoted shearing angle, lies between 5° and 25°; it was chosen to be 20° in this example. The cutting opening is never completely closed during the reciprocating movement. In the one extreme position, a small cutting opening 9' is present between the two cooperating tooth edges 7 and 8, while a larger cutting opening 9" is present between the same cooperating tooth edges in the other extreme position.

FIGS. 3*a-f* show the severing of a hair in a number of consecutive phases. The stroke S is approximately 0.08 mm, and the frequency Q of the reciprocating cutting member 6 is approximately 250 Hz. The figures show the same pair of mutually cooperating teeth each time. FIGS. 3*a*, 3*c*, and 3*e* each show two cooperating teeth for which the cutting opening 9" is a maximum during operation in the one extreme position, whereas FIGS. 3*b*, 3*d*, and 3*f* show the other extreme position, in which the cutting opening 9' is a minimum. The cutting opening thus is never closed during the reciprocating movement, but always remains open. The tooth edges 7 of the stationary teeth 4 are provided with sloping cutting edges (see also FIGS. 4*a,b,c*, and 5*a,b*). The tooth edges 8 of the driven teeth 6 each have two zones 11 and 12. The first zone 11 extends from the tip 13 of the tooth 6 up to the point 14 where the tooth edges 7 and 8 start overlapping in that position in which the cutting opening 9' is smallest (see FIGS. 3*b* and 5*a*). The tooth edge in this zone 11 is a wall portion 15 having a thickness equal to the thickness of the tooth 6 and is directed perpendicularly to the plane of the drawing. The wall portion 15 constitutes an abutment for a hair 16 trapped in the cutting opening. The second zone 12 extends from said point 14 towards the base of the tooth in a region 17 where the tooth edges 7 and 8 overlap. The thickness of the portion 17 of the tooth 6 where the cooperating teeth overlap is much smaller than the rest of the tooth. This is clearly visible in FIGS. 5*a* and 5*b*. The tooth edge 8 at the zone 12 is comparatively thin and forms a counter-cutting edge 18 for the cutting edge 10 of the stationary tooth 4.

Severing of a hair takes place as follows: in FIG. 3*a*, a hair 16 is caught in the cutting opening between the tooth edges of two teeth. It is assumed for simplicity's sake that the cutting opening 9" is greatest in this situation. The tooth 6 subsequently moves to the right, and the wall portion 15 of the tooth edge 8 presses the hair to the right against the cutting edge 10 of the stationary tooth 4 such that the cutting edge penetrates the hair over a certain distance and provides a notch therein (see FIGS. 3*b* and 4*a*). This situation corresponds to that of FIG. 5*a*. The wall portion 15 may accordingly be regarded as a kind of abutment for the hair. In FIG. 3*c*, the tooth 6 has been moved to the left again. Since a user also moves the apparatus over the skin in a direction $P_2$, perpendicularly to the reciprocating movement $P_1$ of the teeth, during shaving, the hair 16 will slide more deeply into the cutting opening 9", while the cutting edge 10 remains in the notch already provided in the hair. This is why the teeth are drawn slightly higher in the plane of the drawing in FIGS. 3*c* and 3*d* than in FIGS. 3*a* and 3*b*. In FIG. 3*d* and FIG. 4*b*, the tooth 6 has been moved to the right again, and the cutting edge 10 has penetrated into the hair still further. The tooth 6 has been moved to the left and upwards again in FIG. 3*e*. The hair is now at the level of the counter-cutting edge 18 of the tooth edge 8. This situation corresponds to that of FIG. 5*b*. The tooth 6 moves to the right again after this (FIGS. 3*f* and 4*c*), and the hair is completely cut through. For a complete severing of a hair in the final phase, it is better that both tooth edges should be provided with cutting edges. The often unpleasant hair pulling during shaving is avoided thereby. It is obviously also possible, however, to provide the entire tooth edge 8 of the moving tooth 6 with a counter-cutting edge instead of dividing it into two zones as described above.

It will be obvious that the number of phases in which a hair is cut through is dependent on the stroke S and the cutting frequency Q.

In the example described above, the one cutting member is stationary and the other cutting member moves. It is alternatively possible to have both cutting members perform a reciprocating movement.

The drive of a cutting member may be effected, for example, by means of a piezoelectric element plus a stroke amplifier.

In a preferred embodiment, not shown in the figures, the shaving apparatus comprises at least two pairs of cooperating cutting members that are movable relative to each other and that are each provided with at least one edge, wherein the edges of each pair of cooperating cutting members cooperate and wherein a cutting opening is present between the edges of each pair of cooperating cutting members for catching hairs, said cutting openings diverging when seen in the shaving direction and not being entirely closed during operation of the apparatus, wherein the two pairs are successively arranged when seen in the shaving direction, and wherein the diverging cutting openings of at least the pair of cooperating cutting members, that is arranged in front when seen in the shaving direction, are obliquely arranged relative to the skin surface during operation. In this embodiment each pair of cooperating cutting members may for example be of a type as shown the FIGS. 2*a*-2*b*, 3*a*-3*f*, or 5*a*-5*b*. The pair of cooperating cutting members, that is arranged in front when seen in the shaving direction, is arranged in an inclined position with respect to the skin surface when the apparatus is placed on the skin surface. In other words, when for example the embodiment of FIGS. 2*a*-2*b* is used, the teeth 4 do not lie flat on the skin surface, but enclose an angle with the skin surface so that only the tips of the teeth 4 contact the skin surface. As a result, also the diverging cutting openings 9', 9" of the front pair of cooperating cutting members are obliquely arranged relative to the skin surface. The result is that when the hairs are progressively catched between the edges (7, 8) of the teeth 4, 6 and the apparatus is moved further in the shaving direction, simultaneously the catched hairs will be partially pulled out of the skin. Subsequently, these hairs will be catched by the pair of cooperating cutting members that follows the front pair of cooperating cutting members. As these hairs are already partially pulled out of the skin, the hairs will be catched and eventually cut by the second pair of cooperating cutting members at positions that were initially below skin surface level, so that the result is an improved smoothness of the skin which will remain for a longer time. It is noted that the second pair of cooperating cutting members may also be arranged obliquely with respect to the skin surface, but this is not necessary. Furthermore, more than two pairs of cooperating cutting members may be arranged behind each other to further improve or optimize the smoothness.

The invention claimed is:

1. A shaving apparatus comprising first and second members that are movable relative to each other, the first member having a first tooth and the second member having a second tooth, edges of the first and second teeth cooperate to perform a cutting operation, wherein a cutting opening is present between the cooperating edges of the first and second teeth, said cutting opening diverging when seen in a direction perpendicular to a cutting plane of the cooperating edges wherein a space remains between at least a portion of the cooperating edges such that the cutting opening is not entirely closed during any time of operation of the shaving apparatus, wherein the cooperating edge of the first tooth includes a sloped cutting edge, and wherein the cooperating edge of the second tooth in a portion of the second tooth that is not overlapped by the first tooth during operation of the shaving apparatus forms an abutment that intersects the cutting plane, the abutment opposing the sloped cutting edge with respect to the relative movement therebetween, the abutment having a first width, the cooperating edge of the second tooth having a second width in the portion of the second tooth that is overlapped by the first tooth during operation of the shaving apparatus, the second width is narrower than the first width.

2. The shaving apparatus as claimed in claim 1, wherein the first and second teeth of the first and second members are each one of a row of substantially V-shaped teeth, wherein each pair of cooperating edges enclose a shearing angle.

3. The shaving apparatus as claimed in claim 2, wherein the shearing angle between the cooperating tooth edges is between 5° and 25°.

4. The shaving apparatus as claimed in claim 2, wherein the first and second cooperating members perform a reciprocating motion with a stroke S relative to one another, wherein S is in a range for which it holds that 0.01 nm<S<to about 0.15 mm, with a frequency Q that is greater than 100 Hz.

5. The shaving apparatus as claimed in claim 4, wherein the stroke S is between 0.05 mm and 0.1 mm and the frequency Q is between 150 Hz and 400 Hz.

6. The shaving apparatus as claimed in claim 2, wherein each one of the cooperating teeth are not completely overlapped by an other one of the cooperating teeth during any time of operation of the shaving apparatus.

7. The shaving apparatus as claimed in claim 1, wherein the sloped cutting edge extends over an entire length of the cooperating edge of the first tooth.

8. The shaving apparatus as claimed in claim 1, wherein the first and second teeth are substantially a same length.

9. The shaving apparatus as claimed in claim 1, wherein the second width forms a counter-cutting edge for cooperating with the sloped cutting edge of the first tooth.

10. A shaving apparatus comprising:

a first tooth;

a second tooth, wherein edges of the first and second teeth move relative to each other to cooperate with each other to perform a cutting operation during operation of the shaving apparatus;

a cutting opening present between the cooperating edges of the first and second teeth, the cutting opening diverging when seen in a direction perpendicular to a cutting plane of the cooperating edges, wherein a space remains between at least a portion of the cooperating edges such that the cutting opening is not entirely closed at any time during operation of the shaving apparatus;

the cooperating edge of the first tooth includes a sloped cutting edge; and the cooperating edge of the second tooth in a portion of the second tooth that is not overlapped by the first tooth during operation of the shaving apparatus forms an abutment that intersects the cutting plane, the abutment opposing the sloped cutting edge with respect to the relative movement therebetween, the abutment having a first width, the cooperating edge of the second tooth having a second width in the portion of the second tooth that is overlapped by the first tooth during operation of the shaving apparatus, wherein the second width is narrower than the first width.

11. The shaving apparatus as claimed in claim 10, wherein the first and second teeth are each one of a row of substantially V-shaped teeth, wherein each pair of cooperating edges enclose a shearing angle.

12. The shaving apparatus as claimed in claim 11, wherein the shearing angle between the cooperating tooth edges is between 5° and 25°.

13. The shaving apparatus as claimed in claim 11, wherein each one of the cooperating teeth are not completely overlapped by an other one of the cooperating teeth any time during operation.

14. The shaving apparatus as claimed in claim 10, wherein the first and second teeth perform a reciprocating motion with a stroke S relative to one another, wherein S is in a range for which it holds that 0.01 nm<S<to about 0.15 mm, with a frequency Q that is greater than 100 Hz.

15. The shaving apparatus as claimed in claim 14, wherein the stroke S is between 0.05 mm and 0.1 mm and the frequency Q is between 150 Hz and 400 Hz.

16. The shaving apparatus as claimed in claim 10, wherein the sloped cutting edge extends over an entire length of the cooperating edge of the first tooth.

17. The shaving apparatus as claimed in claim 10, wherein the first tooth is a stationary tooth during operation.

18. The shaving apparatus as claimed in claim 10, wherein the second width forms a counter-cutting edge for cooperating with the sloped cutting edge of the first tooth.

* * * * *